US006424941B1

(12) United States Patent
Yu

(10) Patent No.: US 6,424,941 B1
(45) **Date of Patent: *Jul. 23, 2002**

(54) ADAPTIVELY COMPRESSING SOUND WITH MULTIPLE CODEBOOKS

(75) Inventor: Alfred Yu, Irvine, CA (US)

(73) Assignee: America Online, Inc., Dulles, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/710,877

(22) Filed: Nov. 14, 2000

Related U.S. Application Data

(60) Continuation of application No. 09/033,223, filed on Mar. 2, 1998, now Pat. No. 6,243,674, which is a division of application No. 08/545,487, filed on Oct. 20, 1995, now abandoned.

(51) Int. Cl.[7] ..... G10L 19/12

(52) U.S. Cl. ..... 704/221; 704/219; 704/222; 704/223; 704/230; 704/220

(58) Field of Search ..... 704/219, 220, 704/221, 222, 223, 224, 262, 230, 264, 200.1

(56) References Cited

U.S. PATENT DOCUMENTS

| | | | | |
|---|---|---|---|---|
| 4,667,340 A | | 5/1987 | Arjmand et al. | |
| 4,731,846 A | | 3/1988 | Secrest et al. | |
| 4,868,867 A | | 9/1989 | Davidson et al. | |
| 5,125,030 A | | 6/1992 | Nomura et al. | |
| 5,127,053 A | | 6/1992 | Koch | |
| 5,199,076 A | | 3/1993 | Traniguchi et al. | |
| 5,206,884 A | | 4/1993 | Bhaskar | |
| 5,245,662 A | * | 9/1993 | Taniguchi et al. | 704/222 |
| 5,265,190 A | | 11/1993 | Yip et al. | |
| 5,323,486 A | * | 6/1994 | Taniguchi et al. | 704/222 |

(List continued on next page.)

FOREIGN PATENT DOCUMENTS

| | | | |
|---|---|---|---|
| JP | 05232994 | 10/1993 | G10L/9/14 |
| WO | WO 93 05502 A | 3/1993 | G10L/5/00 |

OTHER PUBLICATIONS

Shoham, Y., ("Cascaded likelihood vector coding of the LPC information", Acoustics, Speech, and Signal Processing, 1989, ICASSP'89, vol. 1, pp. 160–163).

Chan et al., ("Automatic target recognition using modularly cascaded vector quantizers and mutliplayer perceptrons", Acoustics, Speech, and Signal Processing, 1996, ICASSP96, vol. 6, pp. 3386–3389).

Bhattacharya et al., ("Tree–searched multi–stage vector quantization of LPC parameters for 4Kb/s speech coding", Acoustics, Speech, and Signal Processing, 1992, ICASSP'92, vol. 1, pp. 105–108).

Gersho and Gray, ("constrained Vector Quantization", Chapter 12, Vector Quantization and Signal Compression, Kluwer Academic Publishers, Norwell, MA, pp. 407–487, 1992).

*Primary Examiner*—Vijay B Chawan
(74) *Attorney, Agent, or Firm*—Fish & Richardson P.C.

(57) ABSTRACT

Compression of speech may be achieved through the adaptive generation of a compressed sound output. A first processing element may be used to characterize a first sound representation such that a first characterization result is produced. A comparison element may be provided to compare a first comparison input that is related to the first sound representation with a second comparison input that is related to the first characterization result. A determination may be made on whether further processing is desirable based on whether the first comparison result satisfies a first predetermined threshold criteria. Additionally, a second processing element may be included to characterize a second sound representation and to produce a second characterization result only if the first comparison result satisfies the first predetermined threshold. A compressed sound output is generated whose contents are determined based on at least the first comparison result.

25 Claims, 1 Drawing Sheet

U.S. PATENT DOCUMENTS 5,371,853 A 12/1994 Kao et al.
5,513,297 A 4/1996 Kleijn et al.
5,577,159 A 11/1996 Shoham
5,649,030 A * 7/1997 Normile et al. ..... 382/253
5,699,477 A 12/1997 McCree
5,706,395 A 1/1998 Arslan et al.
5,717,824 A * 2/1998 Chhatwal ..... 704/222
5,734,789 A 3/1998 Swaminathan et al.
5,751,901 A * 5/1998 DeJaco et al. ..... 704/216
5,751,903 A 5/1998 Swaminathan et al.
5,819,212 A 10/1998 Matsumoto et al.
5,819,215 A * 10/1998 Dobson et al. ..... 704/230
5,825,311 A * 10/1998 Kataoka et al. ..... 704/222
5,845,243 A * 12/1998 Smart et al. ..... 704/230
5,857,167 A 1/1999 Gritton et al.
6,044,339 A * 3/2000 Zack et al. ..... 704/223

* cited by examiner

ADAPTIVELY COMPRESSING SOUND WITH MULTIPLE CODEBOOKS

CROSS-REFERENCE TO RELATED APPLICATIONS

This application is a continuation of U.S. Ser. No. 09/033,223, filed Mar. 2, 1998, now U.S. Pat. No. 6,243,674, which is a divisional of U.S. Ser. No. 08/545,487 filed Oct. 20, 1995, now abandoned.

FIELD OF THE INVENTION

The present invention teaches a system for compressing quasi-periodic sound by comparing it to presampled portions in a codebook.

BACKGROUND

Many sound compression schemes take advantage of the repetitive nature of everyday sounds. For example, the standard human voice coding device or "vocoder", is often used for compressing and encoding human voice sounds. A vocoder is a class of voice coder/decoders that models the human vocal tract.

A typical vocoder models the input sound as two parts: the voice sound known as V, and the unvoice sound known as U. The channel through which these signals are conducted is modelled as a lossless cylinder. This model allows output speech to be expressed in terms of the channel and the source stimulation of the channel, thus allowing improved compression.

Many sound compression schemes take advantage of the repetitive nature of everyday sounds. For example, the standard human voice coding device or "vocoder," is often used for compressing and encoding human voice sounds. A vocoder is a class of voice coder/decoder that models the human vocal tract.

A typical vocoder models an input sound as two parts: the voice sound (V), and the unvoice sound (U). The channel through which these signals are conducted is modeled as a lossless cylinder. This model allows output speech to be expressed in terms of the channel and the source stimulation of the channel, thus allowing improved compression.

Strictly speaking, speech is not periodic. Although certain parts of speech may exhibit redundancy or correlation with respect to a prior speech portion, typically speech does not repeat. Nevertheless, speech is often labeled quasi-periodic due to the periodic element added by the pitch frequency of voice sound. Much of the compressibility of speech comes from this quasi-periodic nature. The sounds, however, produced during the un-voiced region are highly random. Therefore, speech is, as a whole, both non-stationary and stochastic.

A vocoder operates to compress the voice source rather than the voice output. The source is, in this case, the glottal pulses which excite the channel to create the human speech we hear. The human vocal tract is complex and can modulate glottal pulses in many ways to form a human voice. Nevertheless, by modeling this complex tract as a simple lossless cylinder, reasonable estimations of the glottal pulses can be predicted and coded. This type of modeling and estimation is beneficial because the source of a voice typically has less dynamic range than the output that constitutes that voice, rendering the voice source more compressible than the voice output.

Additionally, filtering may be used to remove speech portions that are unimportant to the human ear and to provide a speech residue for compression.

The term "residue" refers typically, in the context of a vocoder, to the output of the analysis filter, which is the inverse of the voice synthesis filter used to model the vocal tract. The analysis filter, in effect, deconstructs a voice output signal into a voice input signal by undoing the work of the vocal tract. Presently, however, "residue" is used more generally to refer to the speech representation output by a particular stage of processing. For example, each of the following may constitute or be included within speech residue: the stage 1 output of the inverse or analysis filter; the stage 2 output after adaptive Vector Quantization (VQ); the stage 3 output after pitch VQ; the final stage output after noise VQ.

To process speech, a typical vocoder begins by digitizing an input signal through sampling at 8 kHz with 16 bits per sample. This provides for capture of the full frequency content of a 4 kHz bandwidth signal carried on standard twisted-pair telephone line.

A speech codec may be applied, possibly augmented by other further processing, to enhance signal quality and character.

It is a characteristic of human hearing that relatively high amplitude sound tends to mask sounds of relatively low amplitude to which it is near in either time or frequency domain. In terms of speech processing, this allows a greater level of noise to be tolerated, in either time or frequency domain, where a speech signal is strong. To benefit from this characteristic, a technique called "perceptual weighting" is employed. In this technique, differing weights are applied to the various elements of a speech vector. The values of these weights are determined by the likelihood that the given element will be perceptually important to the human ear—as judged by the strength of the speech signal in both the time and frequency domains. The intent of perceptual weighting is to produce speech vectors which more closely contain only perceptually relevant information, thus aiding compression.

In order to estimate a voice source when given a voice output, a vocoder models the human vocal tract as a set of lossless cylinders of fixed but differing diameters. These cylinders may, in turn, be mathematically approximated by an 8 to 12th order all-pole synthesis filter of the form $1/A(Z)$ (more accurate approximations, although more computationally demanding, may be achieved through the use of pole-zero filters). Its inverse counterpart, $A(Z)$, is an all-zero analysis filter of the same order. Provided a speech source excitation, the corresponding output speech may be determined by stimulating the synthesis filter $1/A(z)$ with the speech source excitation. The vocoder is effective because, in symmetrical fashion, excitation of the analysis filter $A(Z)$ by the voice output signal provides an estimate of the glottal pulses which comprise the voice source signal.

The description above is directed to voice sound compression, nevertheless, the same general principles are also applied to other similar sound types. A speech coding system offers enhanced speech compression while maintaining superior speech sound quality. To achieve this capability, two processing elements may be used.

SUMMARY

In one aspect, a first processing element comprises a first codebook which contains first codes to characterize a first sound representation. First characterization results are generated. The system includes, moreover, a second processing element. The second processing element is comprised of a second codebook which includes second codes. A second sound representation is compared against these codes and second characterization results are generated. Furthermore, a comparison element compares a first comparison input, related to the first sound representation, with a second comparison input, related to the second sound representation. The contents of the compressed sound output are determined based on whether the first comparison satisfies a first predetermined threshold criteria.

In another aspect, the compressed sound representation output includes characterization results from the second codebook only where the comparison satisfies a predetermined threshold criteria. Alternatively, the compressed sound output may be limited to the second characterization results when the comparison satisfies the predetermined threshold.

These aspects ensure that only where an initial match does not provide acceptable speech sound quality is the second processing element with its second vector codebook employed to reduce the error between the input speech sound and the proposed system output.

Moreover, the use of more than two codebooks is encompassed. For example, a system comprising three codebooks is simply two sequential instantiations of the simple two-codebook embodiment of above. Therefore, a further aspect may include a third processing element structured and arranged to characterize a third sound representation and to generate third characterization results. Additionally, a second comparison element may be used which is structured and arranged to perform a second comparison. This second comparison will compare the second comparison input related to the second sound representation and a third comparison input related to the third sound representation. The contents of the compressed sound output are determined based on whether the second comparison satisfies a second predetermined threshold criteria.

In yet another aspect, the system may include within the compressed sound output the third characterization results only where the comparison result satisfies the second predetermined threshold. Alternatively, the compressed sound output may be limited to the third characterization results when the comparison result satisfies the second predetermined threshold.

In a further aspect, the first processing element may include an adaptive vector quantization codebook. Moreover, the second processing element may comprise a real pitch vector quantization codebook which includes a plurality of pitches indicative of voices, while the third processing element comprises a noise vector quantization codebook which includes a plurality of noise vectors.

The inputs to the various codebook elements may comprise perceptually weighted error values. The outputs of these codebook elements may further comprise a residual and an indication of a closest matching code in the codebook. Furthermore, a correlator may be used as a comparison element with inputs including the perceptually weighted error values that constitute the inputs to the three processing elements.

The details of one or more implementations are set forth in the accompanying drawings and the description below. Other features and advantages will be apparent from the description and drawings, and from the claims.

BRIEF DESCRIPTION OF THE DRAWINGS

These and other aspects of the present invention will now be described with reference to the accompanying drawings in which.

DESCRIPTION OF THE PREFERRED EMBODIMENTS

Figure 1:
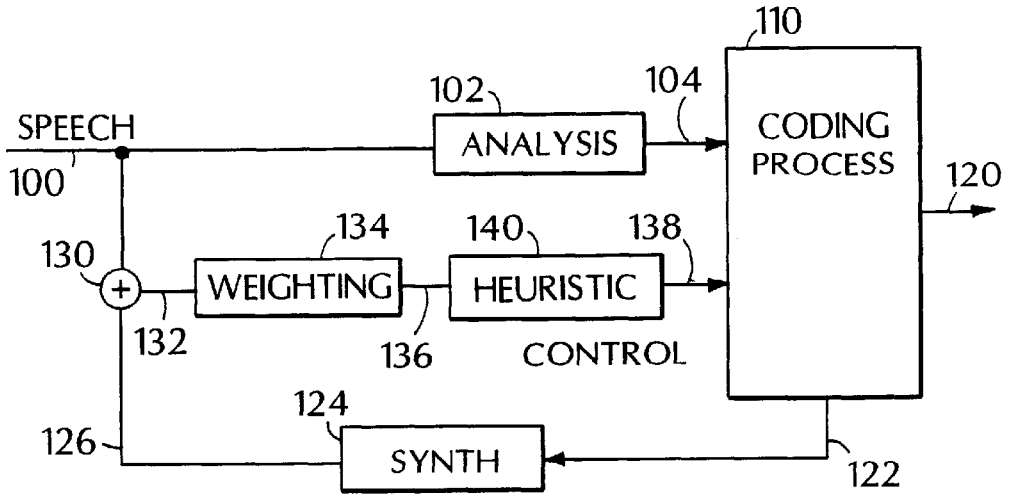
FIG. 1 shows a block diagram off the basic vocoder of the present invention.

FIG. 1 shows the advanced vocoder of the present invention. The current speech codec uses a special class of vocoder which operates based on LPC (linear predictive coding). All future samples are being predicted by a linear combination of previous samples and the difference between predicted samples and actual samples. As described above, this is modeled after a lossless tube also known as an allpole model. The model presents a relative reasonable short term prediction of speech.

The above diagram depicts such a model, where the input to the lossless tube is defined as an excitation which is further modeled as a combination of periodic pulses and random noise.

A drawback of the above model is that the vocal tract does not behave exactly as a cylinder and is not lossless. The human vocal tract also has side passages such as the nose.

Speech to be coded 100 is input to an analysis block 102 which analyzes the content of the speech as described herein. The analysis block produces a short term residual alone with other parameters.

Analysis in this case refers as LPC analysis as depicted above in our lossless tube model, that includes, for example, computation of windowing, autocorrelation, Durbin's recursion, and computation of predictive coefficients are performed. In addition, filtering incoming speech with the analysis filter based on the computed predictive coefficients will generate the residue, the short term residue STA_res 104.

This short term residual 104 is further coded by the coding process 110, to output codes or symbols 120 indicative of the compressed speech. Coding of this preferred embodiment involves performing three codebook searches, to minimize the perceptually-weighted error signal. This process is done in a cascaded manner such that codebook searches are done one after another.

The current codebooks used are all shape gain VQ codebooks. The perceptually-weighted filter is generated adaptively using the predictive coefficients from the current sub-frame. The filter input is the difference between the residue from previous stage versus the shape gain vector from the current stage, also called the residue, is used for next stage. The output of this filter is the perceptually weighted error signal. This operation is shown and explained in more detail with reference to FIG. 2. Perceptually-weighted error from each stage is used as a target for the searching in next stage.

The compressed speech or a sample thereof 122 is also fed back to a synthesizer 124, which reconstitutes a reconstituted original block 126. The synthesis stage decodes the linear combination of the vectors to form a reconstruction residue, the result is used to initialize the state of the next search in next sub-frame.

Comparison of the original versus the reconstructed sound results in an error signal which will drive subsequent codebook searches to further minimize such perceptually-weighted error. The objective of the subsequent coder is to code this residue very efficiently.

The reconstituted block 126 indicates what would be received at the receiving end. The difference between the input speech 100 and the reconstituted speech 126 hence represents an error signal 132.

This error signal is perceptually weighted by weighting block 134. The perceptual weighting according to the present invention weights the signal using a model of what would be heard by the human ear. The perceptually-weighted signal 136 is then heuristically processed by heuristic processor 140 as described herein. Heuristic searching techniques are used which take advantage of the fact that some codebooks searches are unnecessary and as a result can be eliminated. The eliminated codebooks are typically codebooks down the search chain. The unique process of dynamically and adaptively performing such elimination is described herein.

The selection criterion chosen is primarily based on the correlation between the residue from a prior stage versus that of the current one. If they are correlated very well, that means the shape-gain VQ contributes very little to the process and hence can be eliminated. On the other hand, if it does not correlate very well the contribution from the codebook is important hence the index shall be kept and used.

Other techniques such as stopping the search when an adaptively predetermined error threshold has been reached, and asymptotic searches are means of speeding up the search process and settling with a sub-optimal result. The heuristically-processed signal 138 is used as a control for the coding process 110 to further improve the coding technique.

This general kind of filtering processing is well known in the art, and it should be understood that the present invention includes improvements on the well known filtering systems in the art.

Figure 2:
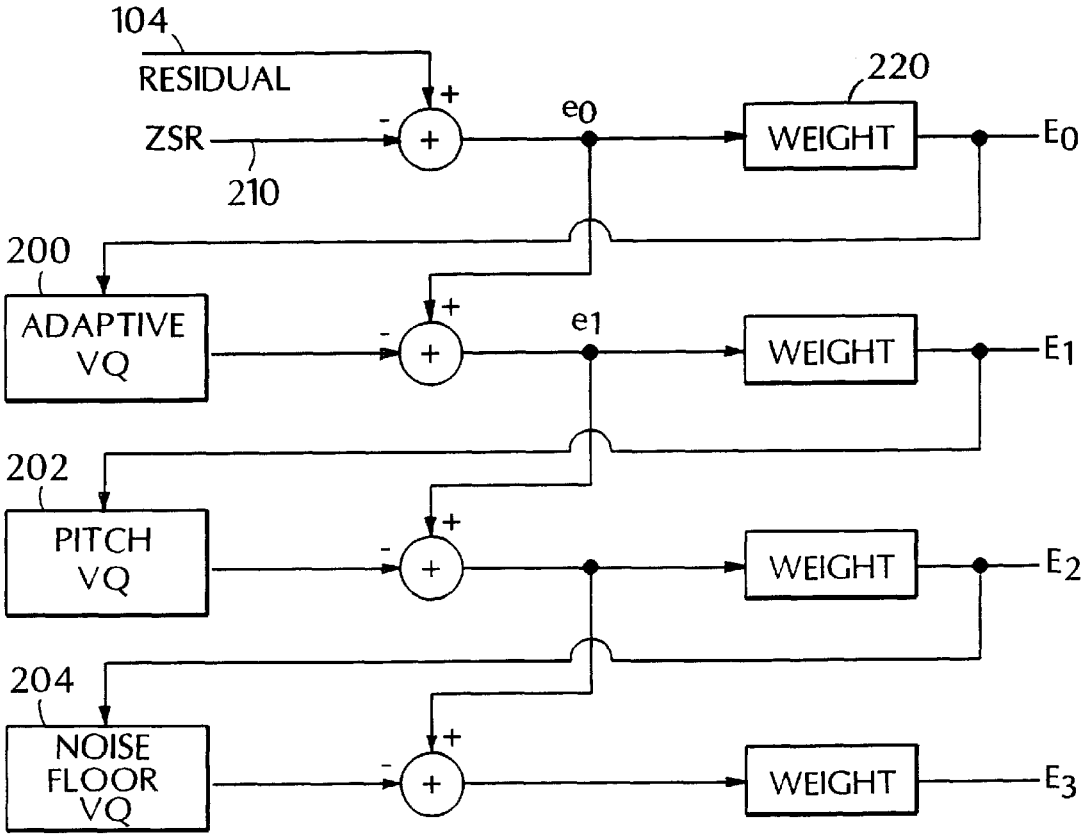
FIG. 2 the advanced codebook technique of the present invention.

The coding according to the present invention uses the codebook types and architecture shown in FIG. 2. This coding includes three separate codebooks: adaptive vector quantatization (VQ) codebook 200, real pitch codebook 202, and noise codebook 204. The new information, or residual 104, is used as a residual to subtract from the code vector of the subsequent block. ZSR (Zero state response) is a response with zero input. The ZSR is a response produced when the code vector is all zeros. Since the speech filter and other associated filters are IIR (infinite impulse response) filters, even when there is no input, the system will still generate output continuously. Thus, a reasonable first step for codebook searching is to determine whether it is necessary to perform any more searches, or perhaps no code vector is needed for this subframe.

To clarify this point, any prior event will have a residual effect. Although that effect will diminish as time passes, the effect is still present well into the next adjacent sub-frames or even frames. Therefore, the speech model must take these into consideration. If the speech signal present in the current frame is just a residual effect from a previous frame, then the perceptually-weighted error signal $E_0$ will be very low or even be zero. Note that, because of noise or other system issues, all-zero error conditions will almost never occur.

$e_0$=STA_res−ϕ. The reason ϕ vector is used is for completeness to indicate zero state response. This is a set-up condition for searches to be taken place. If Eϕ is zero, or approaches zero, then no new vectors are necessary.

E0 is used to drive the next stage as the "target" of matching for the next stage. The objective is to find a vector such that E1 is very close to or equal to zero, where E1 is the perceptually weighted error from e1, and e1 is the difference between e0-vector(i). This process goes on and on through the various stages.

The preferred mode of the present invention uses a preferred system with 240 samples per frame. There are four subframes per frame, meaning that each subframe has 60 samples.

A VQ search for each subframe is done. This VQ search involves matching the 60-part vector with vectors in a codebook using a conventional vector matching system.

Each of these vectors must be defined according to an equation. The basic equation used is of the form that $G_aA_i+G_bB_j+G_cC_k$.

Since the objective is to come up with a minimum perceptually weighted error signal E3 by selecting vectors Ai, Bj, and Ck along with the corresponding gain Ga, Gb, and Gc. This does NOT imply the vector sum of $$G_a{}^*A_i+G_bB_j+G_cC_E=\text{STA_res}.$$

In fact, it is almost never true with the exception of silence.

The error value $E_0$ is preferably matched to the values in the AVQ codebook 200. This is a conventional kind of codebook where samples of previous reconstructed speech, e.g., the last 20 ms, is stored. A closest match is found. The value $e_1$ (error signal number 1) represents the leftover between the matching of $E_0$ with AVQ 200.

According to the present invention, the adaptive vector quantizer stores a 20 ms history of the reconstructed speech. This history is mostly for pitch prediction during voice frame. The pitch of a sound signal does not change quickly. The new signal will be closer to those values in the AVQ than they will to other things. Therefore, a close match is usually expected.

Changes in voice, however, or new users entering a conversation, will degrade the quality of the matching. According to the present invention, this degraded matching is compensated using other codebooks.

The second codebook used according to the present invention is a real pitch codebook 202. This real pitch codebook includes code entries for the most usual pitches. The new pitches represent most possible pitches of human voices, preferably from 200 Hz down. The purpose of this second codebook is to match to a new speaker and for startup/voice attack purposes. The pitch codebook is intended for fast attack when voice starts or when a new person entering the room with new pitch information not found in the adaptive codebook or the so-called history codebook. Such a fast attack method allows the shape of speech to converge more quickly and allows matches more closely to that of the original waveform during the voice region.

Usually when a new speaker enters the sound field, AVQ will have a hard time performing the matching. Hence, E1 is still very high. During this initial time, therefore, there are large residuals, because the matching in the codebook is very poor. The residual $E_1$ represents the new speaker's pitch weighted error. This residual is matched to the pitch in the real pitch codebook 202.

The conventional method uses some form of random pulse codebook which is slowly shaped via the adaptive process in 200 to match that of the original speech. This method takes too long to converge. Typically it takes about 6 sub-frames and causes major distortion around the voice attack region and hence suffers quality loss.

The inventors have found that this matching to the pitch codebook 202 causes an almost immediate re-locking of the signal. For example, the signal might be re-locked in a single period, where one sub-frame period=60 samples=60/8000=

7.5 ms. This allows accurate representation of the new voice during the transitional period in the early part of the time while the new speaker is talking.

The noise codebook 204 is used to pick up the slack and also help shape speech during the unvoiced period.

As described above, the G's represent amplitude adjustment characteristics, and A, B and C are vectors.

The codebook for the AVQ preferably includes 256 entries. The codebooks for the pitch and noise each include 512 entries.

The system of the present invention uses three codebooks. However, it should be understood that either the real pitch codebook or the noise codebook could be used without the other.

Additional processing is carried out according to the present invention under the characteristic called heuristics. As described above, the three-part codebook of the present invention improves the efficiency of matching. However, this of course is only done at the expense of more transmitted information and hence less compression eefficiency. Moreover, the advantageous architecture of the present invention allows viewing and processing each of the error values $e_0$–$e_3$ and $E_0$–$E_3$. These error values tell us various things about the signals, including the degree of matching. For example, the error value $E_0$ being 0 tells us that no additional processing is necessary. Similar information can be obtained from errors $E_0$–$E_3$. According to the present invention, the system determines the degree of mismatching to the codebook, to obtain an indication of whether the real pitch and noise codebooks are necessary. Real pitch and noise codebooks are not always used. These codebooks are only used when some new kind or character of sound enters the field.

The codebooks are adaptively switched in and out based on a calculation carried out with the output of the codebook.

The preferred technique compares $E_0$ to $E_1$. Since the values are vectors, the comparison requires correlating the two vectors. Correlating two vectors ascertains the degree of closeness therebetween. The result of the correlation is a scalar value that indicates how good the match is. If the correlation value is low, it indicates that these vectors are very different. This implies the contribution from this codebook is significant, therefore, no additional codebook searching steps are necessary. On the contrary, if the correlation value is high, the contribution from this codebook is not needed, then further processings are required. Accordingly, this aspect of the invention compares the two error values to determine if additional codebook compensation is necessary. If not, the additional codebook compensation is turned off to increase the compression.

A similar operation can be carried out between $E_1$ and $E_2$ to determine if the noise codebook is necessary.

Moreover, those having ordinary skill in the art will understand that this can be modified other ways using the general technique that a determination of whether the coding is sufficient is obtained, and the codebooks are adaptively switched in or out to further improve the compression rate and/or matching.

Additional heuristics are also used according to the present invention to speed up the search. Additional heuristics to speed up codebook searches are:

a) a subset of codebooks is searched and a partial perceptually weighted error Ex is determined. If Ex is within a certain predetermined threshold, matching is stopped and decided to be good enough. Otherwise we search through the end. Partial selection can be done randomly, or through decimated sets.

b) An asymptotic way of computing the perceptually weighted error is used whereby computation is simplified.

c) Totally skip the perceptually weighted error criteria and minimize "e" instead. In such case, an early-out algorithm is available to further speed up the computation.

Another heuristic is the voice or unvoice detection and its appropriate processing. The voice/unvoice can be determined during preprocessing. Detection is done, for example, based on zero crossings and energy determinations. The processing of these sounds is done differently depending on whether the input sound is voice or unvoice. For example, codebooks can be switched in depending on which codebook is effective.

Different codebooks can be used for different purposes, including but not limited to the well known technique of shape gain vector quantatization and join optimization. An increase in the overall compression rate is obtainable based on preprocessing and switching in and out the codebooks.

Although only a few embodiments have been described in detail above, those having ordinary skill in the art will certainly understand that many modifications are possible in the preferred embodiment without departing from the teachings thereof.

All such modifications are intended to be encompassed within the following claims.

What is claimed:

1. A sound compression system for generating a compressed sound output, comprising:

a first processing element structured and arranged to characterize a first sound representation and to generate a first characterization result;

a first comparison element structured and arranged to generate a first comparison result by at least comparing a first comparison input related to the first sound representation with a second comparison input related to the first characterization result and to determine whether further processing is disirable based on whether the first comparision result satisfies a first predetermined threshold criteria; and an output element structured and arranged to generate a compressed sound output based on at least the first comparison result.

2. The system as in claim 1, further comprising a second processing element structured and arranged to characterize a second sound representation and to generate a second characterization result only if the first comparision result satisfies the first predetermined threshold criteria.

3. The system as in claim 2, wherein the compressed sound output includes the second characterization result and excludes the first characterization result when the first comparison result satisfies the first predetermined output.

4. The system as in claim 2, wherein the first processing element comprises a first codebook that includes first codes for characterizing the first sound representation, and the second processing element comprises a second codebook that includes second codes for characterizing the second sound representation.

5. The system as in claim 4, wherein the second codebook includes at least one code that differs from the codes of the first codebook.

6. The system as in claim 4, wherein the first and second characterization results each comprise an indication of a closest matching code and a residual.

7. The system as in claim 2, wherein the first sound representation and the second sound representation comprise perceptually weighted error values.

8. The system as in claim 7, wherein the first comparison input and the second comparison input used for comparison by the first comparison element comprise perceptually weighted error values.

9. The system as in claim 7, wherein the first comparison input and the second comparison input used for comparison by the first comparison element comprise non-perceptually weighted error values.

10. The system as in claim 2, further comprising a second comparison element structured and arranged to generate a second comparison result by at least comparing a third comparison input related to the second sound representation with a fourth comparison input related to the second characterization result and to determine whether further processing is desirable based on whether the second comparison result satisfies a second predetermined threshold criteria.

11. The system as in claim 10, further comprising a third processing element structured and arranged to characterize a third sound representation and to generate a third characterization result only if the second comparison result satisfies the second predetermined threshold criteria.

12. The system as in claim 11, wherein the compressed sound output may include the third characterization result and exclude the first characterization result and the second characterization result if the second comparison result satisfies the second predetermined threshold.

13. The system as in claim 11, wherein:

the first processing element comprises an adaptive vector quantization codebook;

the second processing element comprises a real pitch vector quantization codebook that includes a plurality of pitches indicative of voices; and the third processing element comprises a noise vector quantization codebook that includes a plurality of noise vectors.

14. The system as in claim 14, wherein the first sound representation characterized by the first processing element comprises a perceptually weighted difference between a first received value indicative of a previous sound and a second received value indicative of a new sound.

15. The system as in claim 14, wherein the second sound representation characterized by the second processing element comprises a perceptually weighted residual of the first processing element; and wherein the third sound representation characterized by the third processing element comprises a perceptually weighted residual of the second processing element.

16. The system as in claim 10, wherein the second comparison element compares the third comparison input and the fourth comparison input only if the first comparison satisfies the first predetermined threshold.

17. The system as in claim 1, wherein the first comparison element performs a correlation function upon the first comparison input and the second comparison input, and the first comparison result is a correlation metric value.

18. The system as in claim 1, wherein the first sound representation comprises the difference between a first received value indicative of a previous sound, and a second received value indicative of a new sound.

19. A method of compressing sound, comprising:

characterizing a first sound representation to produce a first characterization result that includes at least a first processing element residual;

generating a first comparison result by at least correlating a first comparison input related to the first sound representation with a second comparison input related to the first characterization result;

comparing the first comparison result to a first predetermined threshold criteria;

determining whether further processing is desirable based on whether the first comparison result satisfies the first predetermined threshold criteria; and generating a compressed sound output based on the first comparison result.

20. The method as in claim 19, further comprising a second processing element structured and arranged to characterize a second sound representation and to generate a second characterization result only if the first comparison result satisfies the first predetermined threshold criteria.

21. The method as in claim 19, wherein the compressed sound output includes the second characterization result and excludes the first characterization result if the first comparison result satisfies the first predetermined threshold.

22. A sound compression system for generating a compressed sound output, comprising:

a first processing element structured and arranged to characterize a first sound representation and to generate a first characterization result;

a second processing element structured and arranged to characterize a second sound representation and to generate a second characterization result;

a first comparison element structured and arranged to generate a first comparison result by at least comparing a first comparison input related to the first sound representation with a second comparison input related to the second sound representation and to determine contents of the compressed sound output based on whether the first comparison result satisfies a first predetermined threshold criteria; and an output element structured and arranged to generate a compressed sound output based on at least the first comparison result;

wherein the compressed sound output is related to the first characterization result and the second characterization result only if the first comparison result satisfies the first predetermined threshold criteria.

23. The system as in claim 22, further comprising:

a third processing element structured and arranged to characterize a third sound representation and to generate a third characterization result; and a second comparison element structured and arranged to generate a second comparison result by at least comparing the second comparison input related to the second sound representation and a third comparison input related to the third sound representation and to determine the contents of the compressed sound output based on whether a second comparison result satisfies a second predetermined threshold criteria;

wherein the output element is structured and arranged to generate the compressed sound output based on at least the first comparison result and the second comparison result, and the compressed sound output is generated based on the first characterization result, the second characterization result, and the third characterization result only if the second comparison result satisfies the second predetermined threshold criteria.

24. A sound compression system for generating a compressed sound output, comprising:

a first processing element structured and arranged to characterize a first sound representation and to generate a first characterization result;

a second processing element structured and arranged to characterize a second sound representation and to generate a second characterization result;

a first comparison element structured and arranged to generate a first comparison result by at least comparing a first comparison input related to the first sound representation with a second comparison input related to the first characterization result and to determine whether further processing is desirable based on whether the first comparison result satisfies a first predetermined threshold criteria; and an output element structured and arranged to generate a compressed sound output based on at least the first comparison result;

wherein the second processing element is further configured to characterize the second sound representation and to generate the second characterization result only after the first comparison result satisfies the first predetermined threshold criteria.

25. The system as in claim 24, further comprising:

a third processing element structured and arranged to characterize a third sound representation and to generate a third characterization result; and a second comparison element structured and arranged to generate a second comparison result by at least comparing a third comparison input related to the second sound representation and a fourth comparison input related to the second characterization result and to determine whether further processing is desirable based on whether the second comparison result satisfies a second predetermined threshold criteria;

wherein the output element is structured and arranged to generate the compressed sound output based on at least the first comparison result and the second comparison result.

* * * * *